7/22/86 OR 4,601,518

United States Patent [19]

Lanéus

[11] Patent Number: 4,601,518

[45] Date of Patent: Jul. 22, 1986

[54] METHOD OF EXCAVATING ROCK CAVERNS BY BLASTING

[75] Inventor: Per Lanéus, Vallingby, Sweden

[73] Assignee: JCC Johnson Construction Company AB, Stockholm, Sweden

[21] Appl. No.: 591,772

[22] Filed: Mar. 21, 1984

[30] Foreign Application Priority Data

Mar. 23, 1983 [SE] Sweden ..... 8301600

[51] Int. Cl.[4] ..... E21C 41/00

[52] U.S. Cl. ..... 299/13; 405/259

[58] Field of Search ..... 299/13, 2; 405/55, 259

[56] References Cited

U.S. PATENT DOCUMENTS

| | | | |
|---|---|---|---|
| 3,509,726 | 5/1970 | White | 405/259 |
| 3,917,348 | 11/1975 | Janssen | 299/13 |

FOREIGN PATENT DOCUMENTS

| | | | |
|---|---|---|---|
| 0581282 | 11/1977 | U.S.S.R. | 299/13 |
| 0630420 | 9/1978 | U.S.S.R. | 299/13 |
| 0829929 | 5/1981 | U.S.S.R. | 299/13 |
| 0863862 | 9/1981 | U.S.S.R. | 299/13 |
| 0905466 | 2/1982 | U.S.S.R. | 299/13 |
| 0907254 | 2/1982 | U.S.S.R. | 299/13 |
| 1028846 | 7/1983 | U.S.S.R. | 299/13 |
| 1035226 | 8/1983 | U.S.S.R. | 299/13 |

*Primary Examiner*—Stephen J. Novosad
*Assistant Examiner*—Thuy M. Bui
*Attorney, Agent, or Firm*—Curtis Ailes

[57] ABSTRACT

The method produces an elongated rock cavern tunnel, or shaft, preferably with a large cross-sectional area. At least one drilling drift is first driven in the longitudinal direction of the cavern. From that drilling drift first drill holes are drilled in successive planes extending transversely to the longitudinal axis of the intended cavern. Charging and blasting is carried out in the first drill holes for excavating the cavern layer by layer.

The first drill holes are drilled in an essentially ring or fan-shaped pattern and partially outside the intended contour of the cavern. Rock strengthening means is inserted beyond the contour in the drill holes prior to blasting so that the cavern walls and roof have such a degree of stability that work for reinforcing the walls and roof subsequent to blasting can be carried out within the cavern, or that the cavern can be used for its intended purpose, for example for storing liquids, without any further reinforcement following the removal of the blasted rock.

4 Claims, 3 Drawing Figures

METHOD OF EXCAVATING ROCK CAVERNS BY BLASTING

Figure 1:
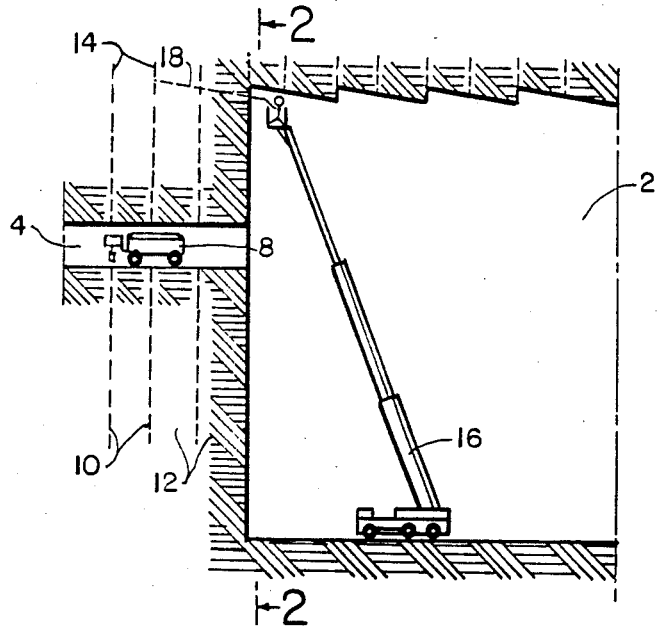

The present invention relates to a method for blasting an essentially elongated rock cavern, or a tunnel, or a shaft, preferably with a large cross-sectional area, comprising driving at least one drilling drift in the longitudinal direction of the cavern, drilling from said drilling drift first drill holes in successive planes extending transversely to the longitudinal axis of the intended cavern, charging and blasting in said first drill holes for excavating said cavern layer by layer.

It is known to excavate large dimension rock caverns by initially blasting a top drift along the entire length of the cavern, with successive reinforcement of the roof of the drift by means of rock bolts and shotcrete, and subsequently lowering the floor in several stages to the desired level by horizontally driving one to three benches. In this way it is normally possible to excavate a chamber with a cross-sectional width of approximately 20 m and a height of about 30 m.

The majority of the drill holes in the top drift, and often in some of the benches, are drilled in the driving direction for each round. Consequently after each blasting the front wall is uneven and sometimes requires extensive scaling before drilling for the next round can commence.

It has also been proposed to blast rock caverns by means of rounds in the form of layers with sizes up to the cross-sectional area of the chamber, which means that the majority of the drill holes are driven transversely to the driving direction. This gives the advantage that a more uniform and less damaged front wall is obtained, whereby less scaling work is necessitated than if the drill holes are drilled in the driving direction.

A common disadvantage of most previous methods is that they are time-consuming and expensive, and do not permit reinforcement of the rock beyond the contour of the cavern until after blasting.

One objective of the present invention is to provide a method of blasting rock caverns and tunnels with large areas, which permits full section advance with simultaneous reinforcement of the rock beyond the contour of the cavern prior to blasting.

According to the invention said drilling, as defined by way of introduction, comprises drilling said first drill holes in an essentially ring or fan-shaped pattern and partially outside the intended contour of said cavern, inserting rock strengthening means beyond said contour in said drill holes prior to blasting, whereby the cavern obtains such a degree of stability that work for reinforcing walls and roof subsequent to blasting can be carried out within the cavern, or that the cavern can be used for its intended purpose, for example for storing liquids, without any further reinforcement works following the removal of the blasted rock, and drilling from a previously excavated part of said cavern, second drill holes along said contour of said cavern in its longitudinal direction to a depth approximately equal to the distance between every two of said successive transverse drilling planes, and using said second holes for presplitting the rock along said contour of said cavern before the round, or smooth blasting of the roof and walls of said cavern concurrent with or subsequent to the round.

Figure 2:
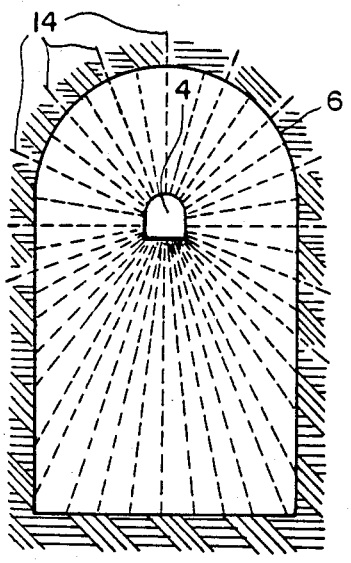

The invention will now be described more closely below with reference to the attached drawings, on which FIG. 1 in longitudinal section and FIG. 2 in cross-section along the plane 2—2 in FIG. 1, illustrate a first embodiment of the method in accordance with the invention, and FIG. 3 in cross-section schematically illustrates a further embodiment.

FIG. 1 shows part of a rock cavern 2 during the course of driving. Driving has commenced from a reaming section (not shown) at one end of the planned cavern. Reaming can be carried out, for example, by widening a raise, driven at one end, in a suitable manner. This is well-proven practice in rock engineering, and does therefore require no further description here.

A drilling drift 4 is driven in the longitudinal direction of the cavern within its planned contours 6. As can be seen from FIG. 2, the drilling drift 4 is arranged essentially symmetrically in the upper half of the cavern. From drilling drift 4 a number of drill holes 10 are drilled by means of ring drilling unit indicated at 8.

More specifically the drill holes 10 are drilled in a circular pattern in several successive planes perpendicularly to the direction of the cavern, so that these planes define essentially disc-shaped sections 12 of the rock between them. Drilling is executed at a distance from the planned contour 6 that is suitable with respect to the subsequent blasting, although, however, certain holes 14 are extended beyond the contour 6 of the cavern and furnished with reinforcement bolts, not shown.

The reinforcements or strengthening means may consist of tubes of steel or reinforced plastic, and the space between each of the tubes and the rock through which the tubes pass is preferably filled with an adhesive substance.

As stated above, the reinforcement means is preferably inserted into the portions of the holes 14 which extend beyond the contour 6 prior to blasting so as to reinforce the walls and the roof prior to blasting.

From a previously excavated part of the cavern, further holes 18 are drilled from a mobile rig indicated at 16 essentially along the roof and wall contour 6 of the cavern to a depth that is somewhat greater than the thickness of two disc-shaped sections 12. The holes 10 in the two currently outermost ring drilling planes are charged with explosives to blast out corresponding outer discs 12 of the rock. The holes 18 can in this context be used for presplitting the rock along the contour 6 prior to the main round, or for smooth blasting of the roof and walls of the cavern simultaneously with or after the main round.

The blasted rock is removed and the roof and walls of the cavern are scaled and reinforced.

Figure 3:
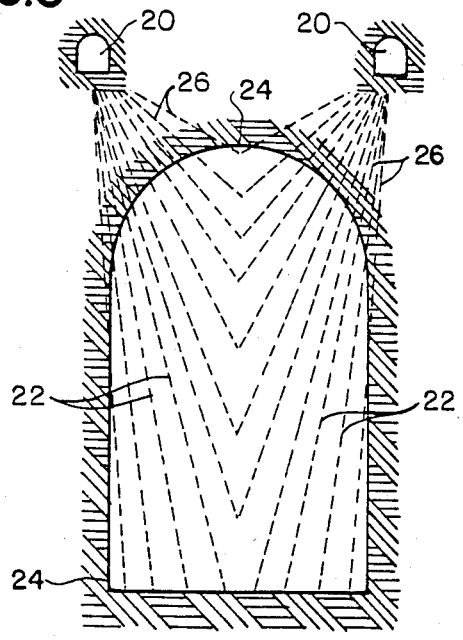

The method intended to be illustrated in FIG. 3 differs from the first embodiment with regard to the location of the drilling drifts. In this case two parallel drilling drifts 20 are driven in the longitudinal direction of the cavern. As shown by the figure, the drilling drifts 20 are located essentially symmetrically in relation to the cavern. From these drifts, drill holes 22 are drilled in a fan-shaped pattern to the planned walls and sides of the cavern. The holes 22 are subsequently charged with explosives within the contour 24 of the cavern. Roof reinforcement is then applied in the form of bolts or cables, not shown, in a portion 26 of certain holes, said portion being located between the drilling drifts 20 and the contour 24, whereupon blasting of the rock layer is carried out.

The caverns, the achievement of which is described above, can have a width of approximately 25 m and a height of about 35 m. As already stated, driving commences from a reaming section at one end of the cavern, but can then continue with the aid of the wheel-mounted working rig 16, adapted to the contours of the cavern for roof and wall works.

From what has been stated above, it should have emerged that two essential advantages can be obtained by the method according to the invention, both of which stem from the use of a ring or fan-shaped pattern for providing drill planes extending transversely to the driving direction so that at least some of the drill holes will pass the contours of the cavern. The first advantage, the realization of which is also an essential part of the invention, is that drill holes extended beyond the contours can be reinforced before the next round. This means that work for reinforcing walls and roof after blasting can take place in the cavern, or alternatively the cavern can be used for its intended purpose, for example the storage of liquids, without the need of further reinforcement works following the removal of blasted rock. The second advantage is that the number of drilling drifts required is minimized. Thus with the embodiment shown in FIGS. 1 and 2 only one centrally located drilling drift is required for a large rock cavern of the dimensions referred to above.

The invention is, of course, not restricted to the embodiments described, but can be modified within the scope of the claims.

Drilling can in general be carried out from two or several drilling drifts, located side by side or above each other within or outside the intended boundary surfaces of the cavern. The excavated slabs can also in certain embodiments extend horizontally or at an inclined angle.

The drilling planes do not necessarily have to be vertical, but can be inclined.

The drilling drift can be driven with its front only a few rounds ahead of a front of the cavern with the drift floor preferably situated level with the bottom of the cavern.

In sections of poor quality rock contour holes are drilled and furnished with iron bars which in previously excavated parts of the cavern are anchored to the rock.

I claim:

1. A method of blasting an essentially elongated rock cavern tunnel, or shaft, preferably with a large cross-sectional area, comprising driving at least one drilling drift in the longitudinal direction of the cavern, drilling from said drilling drift first drill holes in successive planes extending transversely to the longitudinal axis of the intended cavern, charging and blasting in said first drill holes for excavating said cavern layer by layer, said drilling comprising drilling said first drill holes in an essentially ring or fan-shaped pattern and partially outside the intended contour of said cavern, inserting rock strengthening means beyond said contour in said drill holes prior to blasting, whereby the cavern obtains such a degree of stability that work for reinforcing walls and roof subsequent to blasting can be carried out within the cavern, or that the cavern can be used for its intended purpose, for example for storing liquids, without any further reinforcement works following the removal of the blasted rock, and drilling from a previously excavated part of said cavern, second drill holes along said contour of said cavern in its longitudinal direction to a depth approximately equal to the distance between every two of said successive transverse drilling planes, and using said second holes for presplitting the rock along said contour of said cavern before the round, or smooth blasting of the roof and walls of said cavern concurrent with or subsequent to the round.

2. A method in accordance with claim 1, comprising locating the drilling drift or drifts at a distance from said intended contour of said cavern, within and/or outside said contour.

3. A method in accordance with claim 1, comprising using a single drift positioned essentially symmetrically within said intended contour of said cavern.

4. A method in accordance with claim 1, comprising using as said rock strengthening means tubes of steel or reinforced plastic, and filling the space between each of said tubes and the rock with an adhesive substance.

* * * * *